US005139096A

United States Patent [19]

Lister

[11] Patent Number: 5,139,096

[45] Date of Patent: Aug. 18, 1992

[54] PNEUMATIC PERCUSSION HAMMERS

[76] Inventor: William Lister, 36 Rabaul Street, Moorooka, Queensland, 4105, Australia

[21] Appl. No.: 671,905

[22] PCT Filed: Sep. 14, 1989

[86] PCT No.: PCT/AU89/00401

§ 371 Date: Mar. 22, 1991

§ 102(e) Date: Mar. 22, 1991

[87] PCT Pub. No.: WO90/03488

PCT Pub. Date. Apr. 5, 1990

[30] Foreign Application Priority Data

Sep. 22, 1988 [AU] Australia ..... PJ0549

[51] Int. Cl.[5] ..... E21B 4/14

[52] U.S. Cl. ..... 175/92; 173/78; 173/80; 175/215; 175/296

[58] Field of Search ..... 175/296, 213, 215, 92; 173/78, 80, 73

[56] References Cited

U.S. PATENT DOCUMENTS

| | | | |
|---|---|---|---|
| 3,795,283 | 3/1974 | Oughton | 175/92 X |
| 3,941,196 | 3/1976 | Curington et al. | 175/215 X |
| 3,991,834 | 11/1976 | Curington | 175/215 X |
| 4,084,647 | 4/1978 | Lister | 173/73 |
| 4,321,974 | 3/1982 | Klemm | 175/92 |
| 4,705,118 | 11/1987 | Ennis | 175/296 X |
| 4,819,746 | 4/1989 | Brown et al. | 175/296 |
| 4,921,052 | 5/1990 | Rear | 175/215 X |
| 4,921,056 | 5/1990 | Ennis | 175/296 X |

FOREIGN PATENT DOCUMENTS

| | | |
|---|---|---|
| 58052/86 | 12/1986 | Australia . |
| 81767/87 | 5/1988 | PCT Int'l Appl. . |

*Primary Examiner*—Hoang C. Dang
*Attorney, Agent, or Firm*—Foley & Lardner

[57] ABSTRACT

A pneumatic percussion hammer for attachment to a drill tube is coaxially constructed about an outflow tube which is mounted therein for axial removal and replacement when worn. A cylindrical piston moves axially between a top sub wherein a drill stem is screwed, and an anvil of a bit at the bottom. A casing and the piston are configured to valve the flow of pressurized air therethrough for reciprocating motion of the piston and an outflow that carries debris through the outflow tube and drill stem.

3 Claims, 6 Drawing Sheets

PNEUMATIC PERCUSSION HAMMERS

BACKGROUND OF THE INVENTION (1) Field of the Invention

This invention relates to improvements in pneumatic percussion hammers.

(2) Prior Art

The specification of my Australian Patent Application No. 81767/87 describes and illustrates a pneumatic percussion hammer having a tubular casing with a top sub to receive air under pressure from the outer tube of a double tube drill stem, and with a bit having an anvil head slidable in a bottom sub of the casing. An axial air feed tube directs air under pressure through the bit and air passages therethrough and a piston slidable on a central air outflow tube is caused to reciprocate by air under pressure directed through an arrangement of air passages and chambers to strike the anvil in a rapid succession of blows which are transmitted to the bit for rock drilling. These hammers have proved to be very successful, and the present invention has been devised with the general object of adding certain improvements which will broaden the versatility and range of applications of the hammer, as well as facilitating its repair and maintenance.

SUMMARY OF THE PRESENT INVENTION

Accordingly, the invention resides broadly in a pneumatic percussion hammer including:

a tubular casing, a top sub connected to the top of the casing and adapted to receive air under pressure from the outer tube of a double tube drill stem, a bottom sub connected to the housing, an air feed tube disposed coaxially in the casing to conduct air under pressure by way of non-return valve means from the top sub into the casing, an air outflow tube disposed coaxially within the casing and through the air feed tube means for connecting the air outflow tube to the inner tube of the double tube drill stem, a bit slidable in the bottom sub, having a shank axially apertured for slidable engagement on the air outflow tube and with an anvil at its head, an axially apertured piston slidable on the air outflow tube and at its upper part slidable on the air feed tube, and air passages and ports in the piston and chambers in the inner wall of the casing so to direct air under pressure from the air feed tube as to cause the piston to reciprocate to strike the anvil on its downstroke and to exhaust through passages in the bit leading to the bottom of the air outflow tube, the air outflow tube being slidably removable through the top sub.

Other features of the invention will become apparent from the following description.

BRIEF DESCRIPTION OF THE DRAWINGS

A preferred embodiment of the invention is shown in the accompanying drawings, wherein.

DETAILED DESCRIPTION OF THE PREFERRED EMBODIMENT

Figure 1:
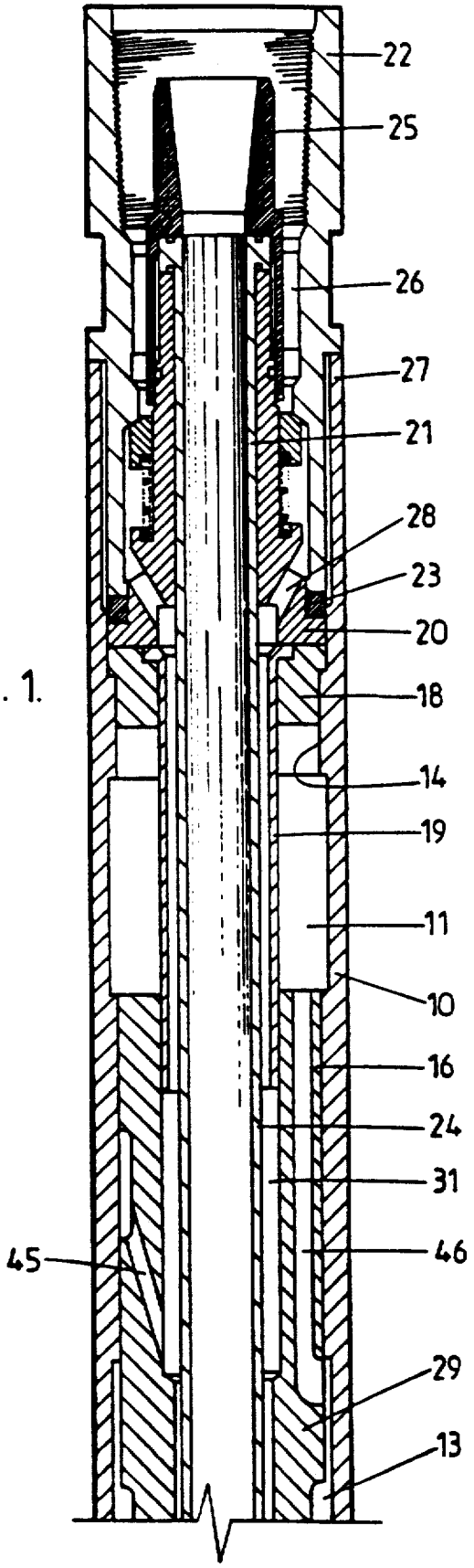
FIG. 1 is a sectional view of the upper part of a pneumatic percussion hammer according to the invention.
Figure 1A:
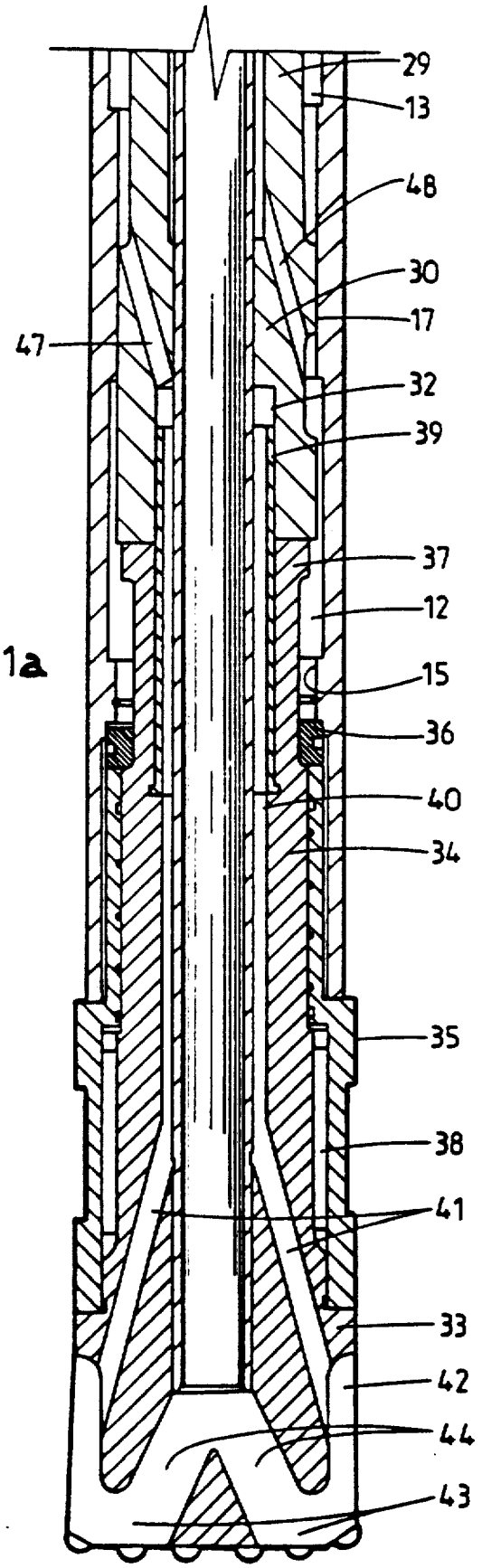
FIG. 1*a* is a sectional view of the lower part of a pneumatic percussion hammer according to the invention.
Figure 2:
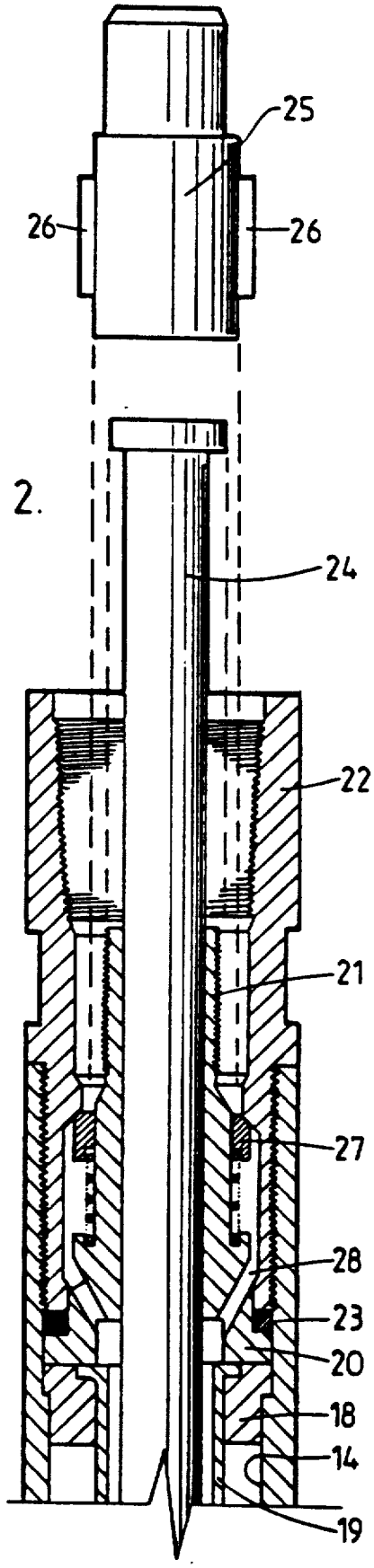
FIG. 2 is a sectional view, to larger scale, of the upper part of the pneumatic percussion hammer shown in FIG. 1, with its adaptor unscrewed and with its air outflow tube partly withdrawn.

The percussion hammer illustrated in FIGS. 1, 1*a*, and 2, to which reference is initially made, includes a cylindrical tubular casing 10, of which each end part of the bore is enlarged and threaded. Two further enlargements of the bore define a top pressure chamber 11 and a bottom pressure chamber 12, and a central bore enlargement defines a central chamber 13. The lesser diameter parts between these chambers comprise a top shoulder 14, a bottom shoulder 15 and top and bottom piston bearings 16 and 17.

A piston stop ring 18 is seated on, and within, the top shoulder 14 and has a seating for the enlarged or flanged top of an air feed tube 19 located coaxially within the casing 10 and held in place by a bottom flange 20 of an axially bored air inlet fitting 21. This fitting 21 is held in place by a top sub 22 screwed into the threaded upper end of the casing 10, its lower end bearing on an annular seal 23 on the base flange 20 of the air inlet fitting 21.

An air outflow tube 24 passes through and is sealed in the air inlet fitting 21 and passes coaxially through the hammer, its enlarged or flanged top seating on the top of the air inlet fitting.

The air outflow tube 24 is releasably held in place by an adaptor 25 screwed onto the threaded upper part of the air inlet fitting. The adaptor has a pair of opposed lugs 26 so that, by using a suitable tool it may be easily unscrewed to enable the air outflow tube 24 to be slidably withdrawn from the hammer, as indicated in FIG. 2.

The top sub 22 and the adaptor 25 may be engaged by a conventional double-tube drill stem (not shown) of a rock drilling assembly, the outer or air inflow tube being screwed into the top sub 22 in usual manner, the central air outflow tube engaging in the adaptor 25. Air passing under pressure down the outer tube of the drill stem passes, against the action of a spring-loaded annular check valve 27 on the air inlet fitting 21, through air passages 28 in the lower part of this fitting into the top of the air feed tube 19.

A piston 29 is slidable in the top and bottom piston bearings 16 and 17 and is axially bored, with a diameter reduction or annular shoulder 30 within the bore. This shoulder 30 divides the piston bore into an upper axial passage 31 and a lower axial passage 32 and fits closely but slidably about the air outflow tube 24. The top part of the upper axial passage 31 receives closely but slidably the air feed tube 19.

A bit 33 has its shank 34 slidably engaged in a driver sub 35 which is screwed into the threaded lower part of the casing 10 and thus holds a split anvil stop ring 36 in place against the bottom shoulder 15, this stop ring limiting the downward movement of the enlarged upper end or anvil 37 of the bit shank 34. The lower part of the bit shank is formed with splines for slidable but non-rotatable movement in corresponding grooves 38 in the bore of the driver sub 35.

A slidable seal tube 39 has its lower end fixed in the top of an .air passage 40 which is formed axially through the bit shank 34. This passage 40 communicates with oblique air ducts 41 leading into flutes 42 formed in the sides of the bit and leading into channels 43 in the bottom of the bit leading in turn to ducts 44 leading convergently upwards to the bottom of the air outflow tube 24, the lower part of which is engaged closely but slidably in the reduced-diameter lower part of the air passage 40.

When the piston 29 is raised so that its top is close to the stop ring 18, air under pressure from the air feed tube 19 enters the upper axial passage 31 of the piston and thence passes through an oblique pressure port 45 into the top pressure chamber 11 to drive the piston down onto the anvil 37, as shown in FIGS. 1 and 1*a* causing the bit to be driven onto the work face. A top exhaust port 46 in the piston then connects the top pressure chamber 11 to the central chamber 13, so that air under pressure flows into the central chamber and thence, through a central chamber exhaust port 47 in the piston to the piston's lower axial passage 32, through the sliding seal tube 39 and the axial passage 40 of the bit shank and through the bit air ducts 41, flutes 42, channels 43, ducts 44 and up through the air outflow tube 24.

When the piston 29 has been driven down onto the anvil 37 as described, air under pressure in the upper axial passage 31 of the piston is conducted through a pressure port 48 in the piston to the bottom pressure chamber 12 to drive the piston upwards until the port 48 is closed upon entering the lower piston bearing 17. The piston rises clear of the sliding seal tube 39 and air under pressure in the bottom pressure chamber 12 expands into the lower axial passage 32 of the piston and thence through the central chamber exhaust port 47 to the central chamber 13. With the upstroke of the piston, air is compressed between it and the piston stop ring 18 to absorb shock and impart reaction air thrust to cause the piston to commence its next downstroke.

While the hammer operates the rock fragments produced are carried up through the hammer in a strong up-flow of air and are brought to ground level through the double tube drill stem without contamination from higher levels of the drilled hole. As soon as the casing 10 is lifted to bring the bit clear of the work face, the bit drops relative to the raised casing until the anvil rests on the anvil stop ring 36, the piston coming to rest on the anvil, the hammer then being in a condition of air balance. As soon as the casing is lowered to bring the bit onto the work face, the hammer will be brought into operation again.

The air outflow tube 24 is subject to considerable wear and is likely to require replacement from time to time. In pneumatic percussion hammers previously made the removal of an air outflow tube has required the prior removal of the top sub and other parts of the hammer. According to the present invention, it is necessary only to unscrew the adaptor 25 after which the air outflow tube 24 may be easily withdrawn, as indicated in FIG. 2.

Figure 3:
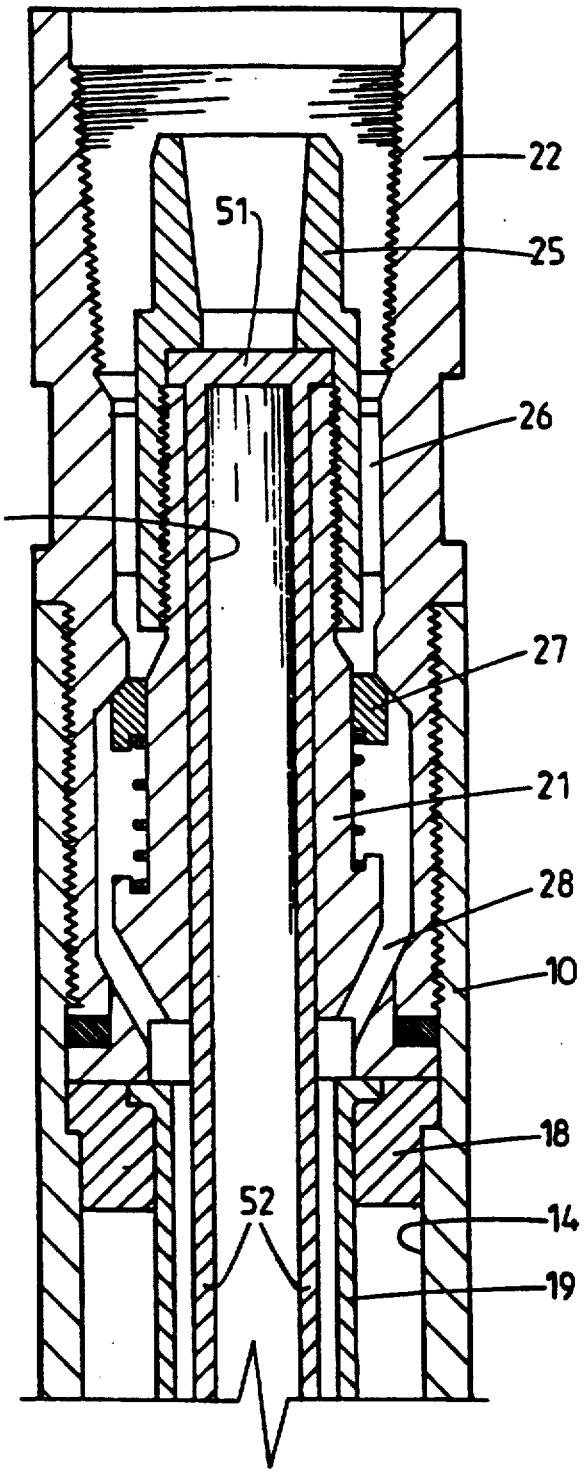
FIG. 3 is a sectioned view to the same scale as FIG. 2 of the upper part of the pneumatic percussion hammer, the air outflow tube shown in FIGS. 1, 1*a*, and 2 being replaced with one of modified type.

The quick and easy removal of the air outflow tube 24 permits its replacement, as may from time to time be required, with tubes of modified character to enable the operation of the hammer to be varied to suit particular drilling requirements. Such a modification is shown in FIG. 3, in which the air outflow tube 24 has been replaced by a capped tube 50 of which the upper end is closed by a cap or plug 51, the tube being formed with apertures 52 which are located below the piston stop ring 18 when the tube is installed. The operation of the pneumatic percussion hammer, in this embodiment, is generally similar to that before described except in that the air introduced to the hammer under pressure from the drill stem passes, as before described, through the oblique air ducts 41 of the bit to the flutes 42, and also by way of the air feed tube 19 and the apertures 52 into the capped tube 50 and thence through the bit ducts 44 to the flutes 42 and the bottom of the bit. The hammer, in this mode, is no longer of reverse circulating type, but operates to carry all of the rock fragments up the outside of the hammer.

Figure 4:
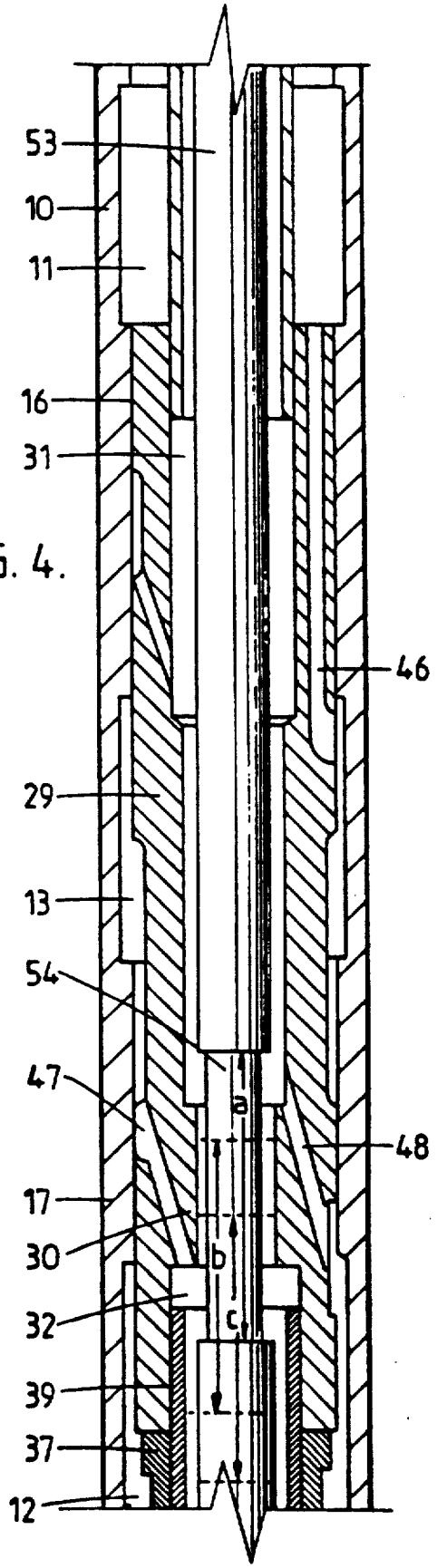
FIG. 4 is a sectioned view to the same scale as FIGS. 2 and 3 of the upper part of the hammer fitted with a modified replacement for the air outflow tubes of the other figures.
Figure 4A:
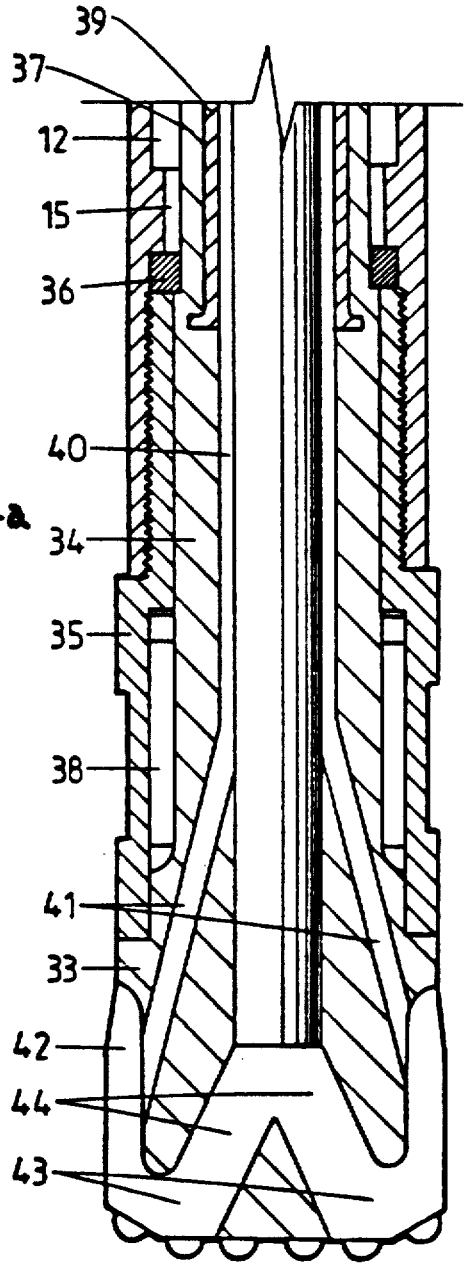
FIG. 4*a* is a sectional view to the same scale as FIGS. 2 and 3 of the lower part of the hammer fitted with a modified replacement for the air outflow tubes of the other figures.

A further, ,modification of the invention is shown in FIGS. 4 and 4*a* which the air outflow tube 24 shown in FIGS. 1, 1*a* and 2 is replaced by a modified air outflow tube 53 having a reduced external diameter section 54 which may be varied in length and in location. When the reduced diameter section 54 is as shown in the drawings, of a length and location indicated as "a", clearance remains at all times during the operation of the hammer between the shoulder 30 within the bore of the piston 29 and the air outflow tube 24. Consequently additional air under pressure will be expelled down through the air passage 40 through the bit shank 34 and by way of the air ducts 41 to the flutes 42 formed in the sides of the bit 33. The bit therefore has about it an amplified shroud of air under pressure. This is found to have very considerable advantages in certain circumstances such as when the percussion hammer has passed through a water-bearing stratum, the pressure of air preventing or greatly reducing ingress of water to the air outflow tube. Therefore even though the hammer is worked through water bearing levels, dry rock chips only will be brought up through the hammer.

If the reduced diameter section 54 instead extends for the distance indicated by "b" in FIG. 4, the extra air under pressure will be fed to the flutes 42 of the bit only when the bit descends suddenly to full extent, as may happen, for example, on encountering a stratum of sand, offering little resistance to the hammer. The extra air under pressure will act to impel the sand up through the air outflow tube 24.

If the reduced diameter section 54 should be located as indicated at "c", then air under pressure will pass to the bit when the hammer is lifted so that the bit drops fully relative to the hammer, and the operation of the hammer ceases. The air under pressure will assist in flushing out the hole.

What is claimed is:

1. A pneumatic percussion hammer including:

a tubular casing, a top sub connected to the top of the casing and adapted to receive air under pressure from the outer tube of a double tube drill stem, a bottom sub connected to the casing, an air feed tube disposed coaxially in the casing to conduct air pressure by way of non-return valve means from the top sub into the casing, an air outflow tube disposed coaxially within the casing and through the air feed tube and means for connecting the air outflow tube to the inner tube of the double tube drill stem, a bit slidable in the bottom sub, having a shank axially apertured for slidable engagement on the air outflow tube and with an anvil at its head, a piston with an axial bore is slidable on the air outflow tube and at its upper part is slidable on the air feed tube, and air passages and ports in the piston and chambers in the inner wall of the casing to direct air under pressure for the air feed tube to cause the piston to reciprocate to strike the anvil on its downstroke and to exhaust through passages in the bit leading to the bottom of the air outflow tube, the air outflow tube being slidably removable through the top sub, wherein, non-return valve means are provided about an air inlet fitting within the top sub and through which the air outflow tube is slidable, and wherein the means for connecting the air flow tube to the inner tube of a double tube drill stem is an adaptor screwed onto the air inlet fitting and releasably securing the air outflow tube in the top sub.

2. A pneumatic percussion hammer including:

a tubular casing, a top sub connected to the top of the casing and adapted to receive air under pressure from the outer tube of a double tube drill stem, a bottom sub connected to the casing, an air feed tube disposed coaxially in the casing to conduct air pressure by way of non-return valve means from the top sub into the casing, an air outflow tube disposed coaxially within the casing and through the air feed tube and means for connecting the air outflow tube to the inner tube of the double tube drill stem, a bit slidable in the bottom sub, having a shank axially apertured for slidable engagement on the air outflow tube and with an anvil at its head, a piston with an axial bore is slidable on the air outflow tube and at its upper part is slidable on the air feed tube, and air passages and ports in the piston and chambers in the inner wall of the casing to direct air under pressure for the air feed tube to cause the piston to reciprocate to strike the anvil on its downstroke and to exhaust through passages in the bit leading to the bottom of the air outflow tube, the air outflow tube being slidably removable through the top sub, wherein, the air outflow tube is closed at its upper end and therebelow is apertured to receive air under pressure from the air feed tube so that all air under pressure from the drill stem enters the air outflow tube and is expelled therefrom through the bit.

3. A pneumatic percussion hammer including:

a tubular casing, a top sub connected to the top of the casing and adapted to receive air under pressure from the outer tube of a double tube drill stem, a bottom sub connected to the casing, an air feed tube disposed coaxially in the casing to conduct air pressure by way of non-return valve means from the top sub into the casing, an air outflow tube disposed coaxially within the casing and through the air feed tube and means for connecting the air outflow tube to the inner tube of the double tube drill stem, a bit slidable in the bottom sub, having a shank axially apertured for slidable engagement on the air outflow tube and with an anvil at its head, a piston with an axial bore is slidable on the air outflow tube and at its upper part is slidable on the air feed tube, and air passages and ports in the piston and chambers in the inner wall of the casing to direct air under pressure for the air feed tube to cause the piston to reciprocate to strike the anvil on its downstroke and to exhaust through passages in the bit leading to the bottom of the air outflow tube, the air outflow tube being slidably removable through the top sub, wherein, the axial bore of the piston has an internal annular shoulder through which the air outflow tube is closely slidable and which divides the axial bore into upper and lower axial passages of larger diameter than the annular shoulder, and wherein the air outflow tube has a section so reduced in external diameter as to allow, during part of each stroke of the piston, air pressure to pass from the upper to the lower axial passage and thence to the said passages in the bit.

* * * * *